US007942263B2

(12) United States Patent
Block

(10) Patent No.: US 7,942,263 B2
(45) Date of Patent: May 17, 2011

(54) BEVERAGE CONTAINER PACKAGE AND DISPENSER

(75) Inventor: Steven J. Block, Amelia, OH (US)

(73) Assignee: The C.W. Zumbiel Co., Cincinnati, OH (US)

( * ) Notice: Subject to any disclaimer, the term of this patent is extended or adjusted under 35 U.S.C. 154(b) by 222 days.

(21) Appl. No.: 12/252,601

(22) Filed: Oct. 16, 2008

(65) Prior Publication Data

US 2010/0096441 A1 Apr. 22, 2010

(51) Int. Cl.
*B65D 65/00* (2006.01)

(52) U.S. Cl. ..... 206/432; 206/497

(58) Field of Classification Search ..... 206/427–432, 206/434, 497

See application file for complete search history.

(56) References Cited

U.S. PATENT DOCUMENTS

| | | | | |
|---|---|---|---|---|
| 2,654,474 | A | 10/1953 | Ringler | |
| 2,705,556 | A | 4/1955 | Ringler | |
| 3,118,537 | A | 1/1964 | Copping | |
| 3,144,130 | A | 8/1964 | Copping | |
| 3,206,020 | A | 9/1965 | Billingsley et al. | |
| 3,217,874 | A | 11/1965 | Potter | |
| 3,219,183 | A | 11/1965 | Potter et al. | |
| 3,302,783 | A | 2/1967 | Lyon | |
| 3,302,784 | A * | 2/1967 | Copping | 206/432 |
| 3,331,503 | A | 7/1967 | Brown | |
| 3,338,404 | A | 8/1967 | Becker et al. | |
| 3,347,365 | A | 10/1967 | Funkhouser | |
| 3,353,326 | A | 11/1967 | Becker | |
| 3,385,429 | A | 5/1968 | Becker | |
| 3,388,788 | A | 6/1968 | Hellem | |
| 3,403,779 | A | 10/1968 | Becker et al. | |

(Continued)

OTHER PUBLICATIONS

The International Search Report and the Written Opinion of the International Searching Authority, or the Declaration, International Searching Authority, PCT/US2009/054247, Oct. 14, 2009, 8 pgs.

*Primary Examiner* — Luan K Bui
(74) *Attorney, Agent, or Firm* — Wood, Herron & Evans, LLP

(57) ABSTRACT

A package for a number of beverage containers includes an overlay member covering the top ends of the beverage containers. The overlay member has a central, generally planar panel positioned atop the top ends of the beverage containers and a number of perimeter panels each joined to and positioned on a perimeter of the central panel. Each perimeter panel is oriented generally perpendicularly relative to the central panel. A dispenser opening is in the central panel of the overlay member through the beverage containers may be removed from the package. A dispenser flap is adjacent the dispenser opening and a perimeter edge of the overlay member. The dispenser flap may be pulled outwardly from the overlay member by a user to provide access through which the beverage containers may be removed from the package. An overwrap member such as a thermoplastic shrink wrap film envelops the array of beverage containers and the overlay member to provide a robust, unitary package for transport and storage. A line of perforations in the overwrap member is aligned with the dispenser to allow a user to puncture the overwrap member in the vicinity of the line of perforations and gain access to the beverage containers via the dispenser. The package may be supported on a shelf such as within a refrigerator or storage rack with a side of the package facing downwardly and the dispenser positioned proximate the downwardly facing side of the package.

24 Claims, 3 Drawing Sheets

U.S. PATENT DOCUMENTS 3,477,564 A 11/1969 Crabtree
3,488,913 A 1/1970 Burgess
3,491,878 A 1/1970 Britton et al.
3,525,428 A 8/1970 Stephan
3,532,214 A 10/1970 Helms
3,542,193 A * 11/1970 Hewlett et al. ..... 206/497
3,552,559 A 1/1971 Kirby
3,600,872 A 8/1971 Sharpnack, Jr.
RE27,212 E 11/1971 Brown
3,650,394 A 3/1972 De Cazenove
3,650,395 A 3/1972 Hobbs
T900,020 I4 7/1972 Britt et al.
3,674,136 A 7/1972 Forrer
3,675,767 A 7/1972 Taylor
3,687,282 A 8/1972 Owen
3,688,972 A 9/1972 Mahon
3,690,453 A 9/1972 Dorall
3,693,787 A * 9/1972 Duerr ..... 206/432
3,734,280 A 5/1973 Ammeus et al.
3,747,749 A * 7/1973 Brown ..... 206/432
3,747,750 A 7/1973 Chapman
3,750,876 A 8/1973 Throberg
3,756,397 A 9/1973 Ganz
3,866,818 A * 2/1975 Smith ..... 206/427
3,883,000 A 5/1975 Gibbs
4,036,362 A 7/1977 Ullman
4,062,448 A 12/1977 Meighan
4,077,516 A 3/1978 Duerr
4,078,659 A 3/1978 Rensner
4,094,406 A 6/1978 Zietzschmann
4,212,955 A 7/1980 Tobias et al.
4,224,416 A 9/1980 Taylor et al.
4,304,332 A 12/1981 Danti
4,333,570 A 6/1982 Heider
4,382,506 A 5/1983 Chaussadas
4,475,653 A 10/1984 Ullman
4,567,981 A 2/1986 Headon
4,586,312 A 5/1986 Limousin
4,609,101 A 9/1986 Ullman
4,779,731 A * 10/1988 Fujio ..... 206/432
4,789,063 A 12/1988 Hammett
4,807,751 A 2/1989 Klygis et al.
4,919,265 A 4/1990 Lems et al.
4,953,702 A 9/1990 Bryan
4,971,197 A 11/1990 Worley
4,998,615 A 3/1991 Bryan
4,998,619 A 3/1991 Sowa et al.
5,016,761 A 5/1991 Stoddard et al.
5,035,323 A 7/1991 Daniels et al.
5,154,289 A 10/1992 Van Erden
5,160,030 A * 11/1992 Binsfeld ..... 206/497
5,201,463 A 4/1993 George
5,249,738 A 10/1993 Werth
5,282,348 A 2/1994 Dampier et al.
5,363,954 A 11/1994 Dampier et al.
5,551,563 A 9/1996 Allen
5,685,428 A 11/1997 Herbers et al.
5,755,326 A 5/1998 O'Neill
5,813,540 A 9/1998 Vollbrecht et al.
5,887,717 A 3/1999 Anderson et al.
6,050,058 A 4/2000 Loreto et al.
6,105,776 A 8/2000 Meilhon
6,182,422 B1 2/2001 Andersen et al.
6,499,596 B1 12/2002 Andersen et al.
6,588,594 B2 7/2003 Andersen et al.
6,874,633 B2 4/2005 Andersen et al.
6,978,892 B2 12/2005 Bansal et al.
6,978,895 B2 12/2005 Tumminia
7,370,761 B2 5/2008 Andersen et al.
7,392,905 B2 7/2008 Andersen et al.
7,823,721 B2 11/2010 Sutherland et al.
2003/0155266 A1 8/2003 Andersen et al.
2005/0139502 A1 6/2005 Andersen et al.
2006/0186009 A1 8/2006 Perkinson
2007/0080087 A1 4/2007 Lentner et al.
2007/0205255 A1 9/2007 Dunn
2007/0215504 A1 9/2007 Walker
2007/0215505 A1 9/2007 Walker
2009/0127147 A1 5/2009 Sutherland

* cited by examiner

BEVERAGE CONTAINER PACKAGE AND DISPENSER

BACKGROUND OF THE INVENTION

This invention relates generally to packages for beverage containers, bottles and cans, and more particularly to a package that is economical to manufacture, robust in use and from which the beverage containers can be easily and conveniently dispensed.

The packaging of multiple beverage containers such as bottles and cans has for many years been achieved by the use of pre-scored and pre-folded paperboard cartons or carriers which encircle the containers. Recently, a trend toward cheaper thermoplastic film materials which can be heat shrunk into close conforming relationship to a group of containers has emerged. While such shrink wrap packages may be more economical than the paperboard cartons and carriers, the shrink wrap film readily tears at high stress concentration areas of the package due to the thin film that is used in providing a more economical package. In those instances where the film has been strong enough, because the films are thicker, to prevent accidental tearing of the package, the packages have been relatively difficult for the consumer to open and conveniently gain access to the containers therein.

Several attempts have been made to strike a balance that appears necessary to produce a commercial thermoplastic film-type package. It has been difficult, however, to provide an economical package which combines the requisite strength for handling and at the same time offers convenient access to the containers for the consumer.

For example, bottled water has become very popular for retail purchase and PET bottles are commonly used as the container. Similar to many consumer beverages, the bottles are sold in packages of typically at least four bottles up to as many as 24 to 36 or more per package. However, unlike packaging for soda, soft drinks and beer, bottled water packages typically are very basic and conventional consisting of a paperboard tray supporting the bottom of the bottles and the entire package being enveloped in shrink wrap plastic or the like. The relatively low level of sophistication for the bottled water packages is, in part, a result of the low profit margins and economic limitations associated with bottled water sales. Manufacturers and bottlers are not able to economically justify the added cost of production associated with sophisticated packages and dispensers for bottled water while still maintaining competitive retail pricing.

Additionally, consumers commonly purchase large quantities of bottled water and often each package includes 24 to 36 or more bottles. It is difficult, if not impossible, for a consumer to conveniently transfer the entire package to their refrigerator for cooling, storage and convenient access. As an alternative, consumers often remove individual bottles from the package for consumption or transfer to the refrigerator and this piece-meal dispensing of the bottles is inconvenient and continual attention to stocking and re-stocking the refrigerator with bottled water is required.

Therefore, an improved package for bottled water and other beverage containers is needed that satisfies these and other shortcomings associated with know beverage container packages.

SUMMARY OF THE INVENTION

This invention solves these and other problems and, in one embodiment, includes a paperboard overlay member of a size to cover the top caps of the assembled bottles. In one embodiment, the package includes 12 bottles in a 4×3 arrangement, but other sizes of packages and arrangements of bottles are possible with this invention. The rectangular shape of the overlay member is sized to cover the caps of the 12 bottles and perimeter panels extending from each edge of a central, rectangular panel of the overlay member are folded downwardly to form an inverted tray. The tray includes a dispenser in the rectangular central panel which, in one embodiment is a dispenser flap adjacent one of the longitudinal edges of the central panel. Perforated tear lines are provided at each lateral edge of the dispenser flap to allow the flap to be folded downwardly. The dispenser may include a cut-out portion in the overlay member alone or in combination with and adjacent to the dispenser flap.

After the bottles are arranged in the desired configuration and the overlay member is placed atop the caps with the perimeter panels folded downwardly, the package is enveloped in an overwrap member such as thermoplastic shrink wrap film as is well known in the industry. The package is easily handled, sturdy and well constructed for shipping, storing and merchandising. Once the consumer brings the package home, they can easily place it in the refrigerator or on a shelf with the overlay member and bottle caps facing forwardly. Perforations or scores are provided in the overwrap and in registration with the dispenser flap and/or dispenser opening member cut-out in the overlay member so that a user may easily insert their hand through the shrink wrap and into the cut-out, tear the shrink wrap in the region of the dispenser flap, tear the dispenser flap along the perforations in the overlay member and fold the flap downwardly toward the shelf. As such, the package is conveniently stored on the shelf of a refrigerator or elsewhere and individual bottles can be accessed from the package through the dispenser all without compromising the integrity of the package and remaining bottles therein. This robust and easy to use package is provided with a minimum of cost to the bottler, manufacturer, retailer and consumer.

BRIEF DESCRIPTION OF THE DRAWINGS

The above-mentioned and other features and advantages of this invention, and the manner of attaining them, will become more apparent and the invention itself will be better understood by reference to the following description of embodiments of the invention taken in conjunction with the accompanying drawings, wherein.

DETAILED DESCRIPTION OF THE INVENTION

Figure 2:
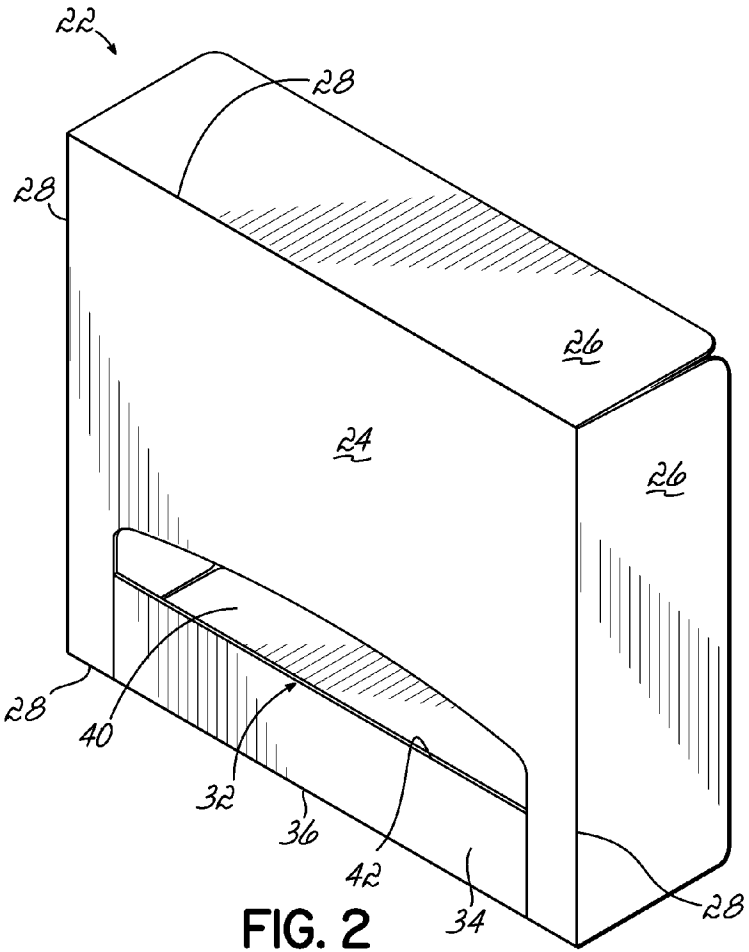
FIG. 2 is a perspective view of the overlay member of FIG. 1 in an erected and folded configuration.
Figure 1:
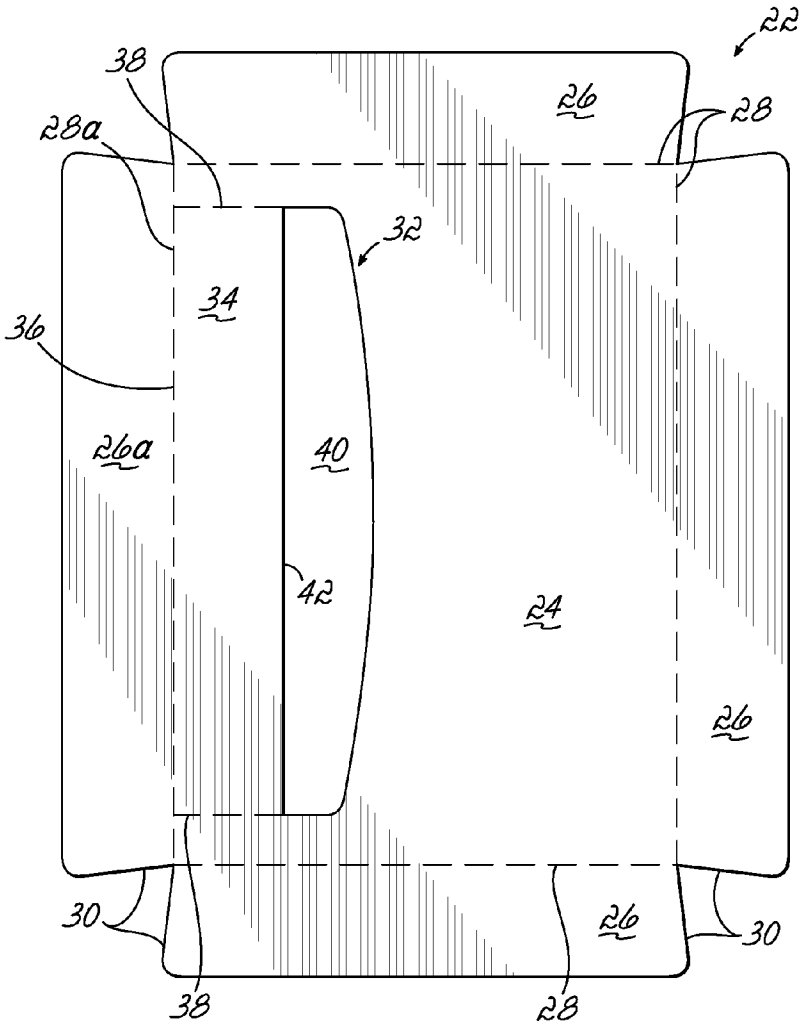
FIG. 1 is a plan view of an overlay member of a package according to one embodiment of this invention.
Figure 3:
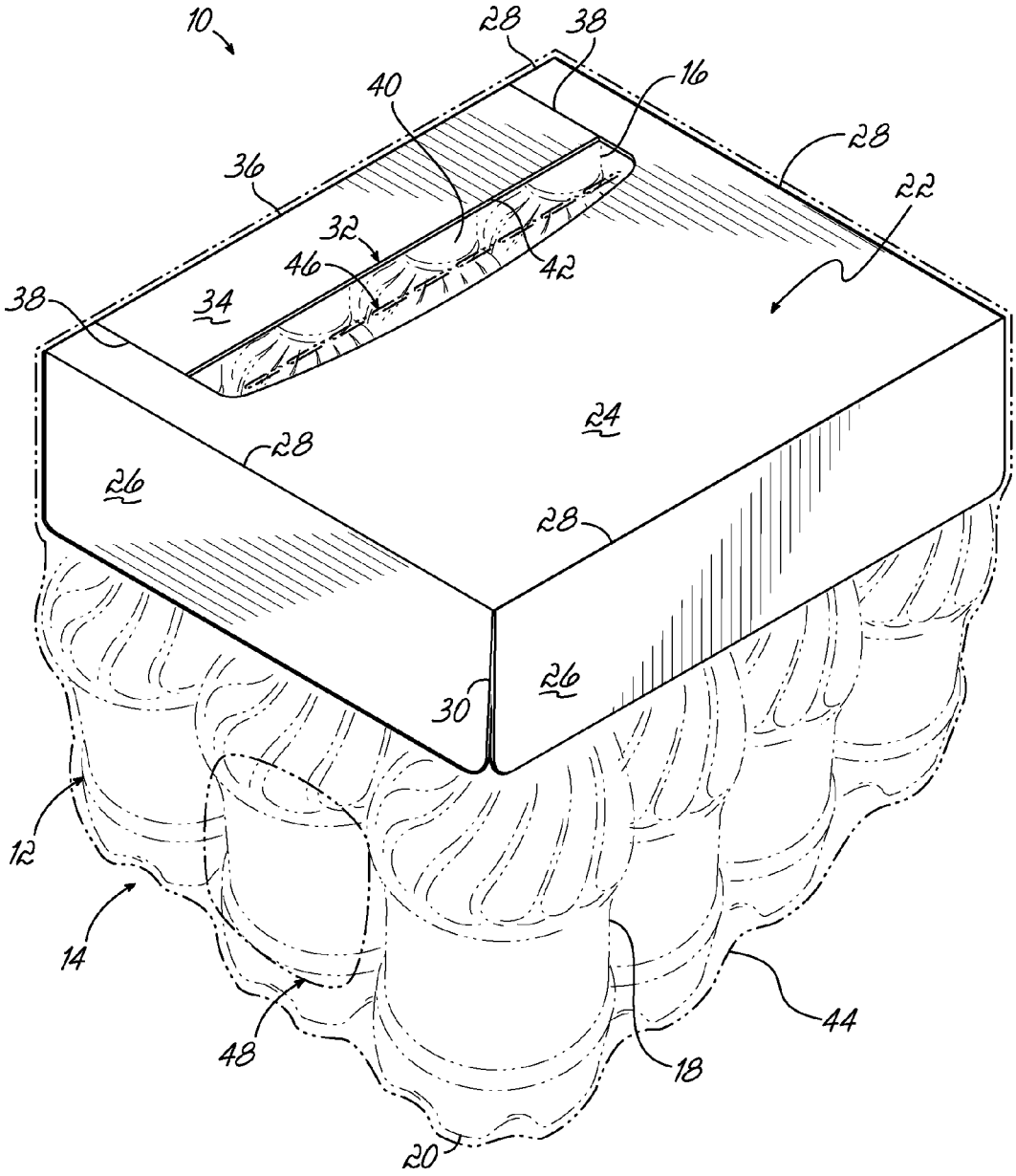
FIG. 3 is a perspective view of the erected overlay member of FIG. 2 in position relative to a number of beverage containers and encased by an overwrap member to form a beverage package according to one embodiment of this invention.

Referring to FIGS. 1-3, one embodiment of a package 10 for beverage containers 12 according to this invention is shown. The beverage containers 12 as shown in FIG. 3 are arranged in a single layer array 14 in a 4×3 matrix. Each beverage container 12 as shown in FIG. 3 is a polyethylene terephthalate (PET) bottle having an upper opening closed by a bottle cap 16, an arcuate sidewall 18 and a base or bottom 20. While PET bottles are shown arranged in a 4×3 matrix array 14 in FIG. 3, this invention is readily applicable for beverage containers 12 of a different type, style, arrangement and number. For example, it is well recognized in the industry that beverages are available for retail sale in PET bottles and other bottle materials such as glass or another plastic, aluminum cans, foil pouches or any container material and configuration. Likewise, while a 4×3 matrix of beverage containers 12 is shown in FIG. 3, other arrangements and assembly of beverage containers 12 are available within the scope of this invention, including multi-layer arrangements and the like.

The package 10 according to one embodiment of this invention includes an overlay member 22, one embodiment of which is shown in FIGS. 1-2. According to one embodiment and as shown in FIGS. 1-2, the overlay member 22 is a paperboard sheet material of 0.018 carrier board. However, other materials including corrugated plastic and other configurations of the overlay member 22 may be utilized within the scope of this invention. The overlay member 22 of FIGS. 1-2 has a generally rectangular and planar central panel 24 of a size and configuration to cover the bottle caps 16 and top ends of the array 14 of beverage containers 12 in the package 10. In one embodiment, the bottle caps 16 and top ends of the beverage containers 12 do not project or protrude through the overlay member 22 according to this invention.

Perimeter panels 26 are each joined to and positioned on respective perimeter edges of the central panel 24 as shown particularly in FIG. 1. A score, crease or fold line 28 is provided at the juncture of each perimeter panel 26 and the associated edge of the central panel 24 so that the associated perimeter panel 26 may be folded approximately 90° relative to the plane of the central panel 24. When each of the perimeter panels 26 is folded along the associated fold line 28, the overlay member 22 is formed into a tray-like configuration as shown in FIG. 2. In one embodiment, each perimeter panel 26 has tapered or flared side edges 30 so that when each of the perimeter panels 26 is folded into the configuration of FIG. 2, it does not interfere with the adjacent perimeter panels 26 in forming the tray configuration of FIG. 2.

The overlay member 22 of one embodiment of this invention includes a dispenser 32 through which the beverage containers 12 in the package 10 may be accessed and removed. In one embodiment, the dispenser 32 includes a dispenser flap 34 in the central panel 24 of the overlay member 22. The dispenser flap 34 is positioned adjacent a perimeter edge 36 of the central panel 24 of the overlay member 22 along the fold line **28*a* joining the associated perimeter panel 26*a*. A pair of tear lines 38 which may be perforations or another other type of tear line, emanate from the fold line 28*a* and are oriented generally perpendicular to the fold line 28*a* as shown particularly in FIG. 1**.

The dispenser 32 according to one embodiment of this invention also includes a dispenser opening 40 in the central panel 24 of the overlay member 22. The dispenser opening 40 as shown in FIGS. 1-2 is positioned adjacent to a terminal free edge 42 of the dispenser flap 34 and is oriented longitudinally in the central panel 24 and adjacent one side edge 36 of the central panel 24. As shown in FIGS. 1-2, the dispenser 32 of one embodiment of this invention is positioned asymmetrically relative to a longitudinal axis of the overlay member 22 and package 10. The terminal free edge 42 of the dispenser flap 34 borders the dispenser opening 40 according to one embodiment of this invention. However, a dispenser 32 according to this invention may include only the dispenser flap 34, only the dispenser opening 40 or a combination of the dispenser flap 34 and the dispenser opening 40 as shown in FIGS. 1-2. As shown in FIGS. 1-3, the dispenser opening 40 is oriented longitudinally and the array 14 includes four beverage containers 12 oriented longitudinally in the embodiment shown in FIG. 3 and three beverage containers 12 oriented in the perpendicular or lateral direction of the package in FIG. 3. Other arrangements, designs or configurations for the dispenser 32 are available within the scope of this invention.

The overlay member 22 with the perimeter panels 26, **26*a* folded as shown in FIG. 2 is positioned atop the caps 16 of the beverage containers 12 as shown in FIG. 3. The package 10 according to one embodiment of this invention also includes an overwrap member 44 which envelopes or covers at least a substantial portion of the array 14 of beverage containers 12 and the overlay member 22. In one embodiment, the overwrap member 44 may be a thermoplastic heat-shrinkable film applied around the overlay member 22 and containers 16 and heated in a heat-shrink oven to form a tightly conforming overwrap member 44. Heat-shrink plastic films and associated heat-shrink technology are well known in the industry for enveloping beverage containers 12** and such technology is readily available from Lantech (Lantech.com) as well as other shrink-wrap equipment providers.

The overwrap member 44 in one embodiment of this invention includes a weakened portion 46 relative to the remainder of the overwrap member 44. The weakened portion 46 may be a frangible access portion defined by perforations in the overwrap member 44. The perforations 46 are positioned relative to the dispenser 32 to allow a user to puncture the overwrap member 44 in the vicinity of the weakened portion 46 to gain access to the beverage containers 12 in the package 10 via the dispenser 32. In the embodiment shown in FIG. 3, the weakened portion 46 of the overwrap member 44 is a line of perforations extending longitudinally on the package 10 and positioned and aligned relative to the dispenser opening 40. While a single line of perforations in the overwrap member 44 is shown in FIG. 3, the weakened portion 46 of the overwrap member 44 may be any configuration or design other than perforations or a line thereof within the scope of this invention.

The overwrap member 44 substantially covers the beverage containers 12 and overlay member 22, but a small portion 48 of the package 10 may not be enveloped by the overwrap member 44 as shown in FIG. 3 and as is well known in the industry. Nevertheless, the overwrap member unifies the array 14 of beverage containers 12 and overlay member 22 into a robust unitary package 10.

Figure 4:
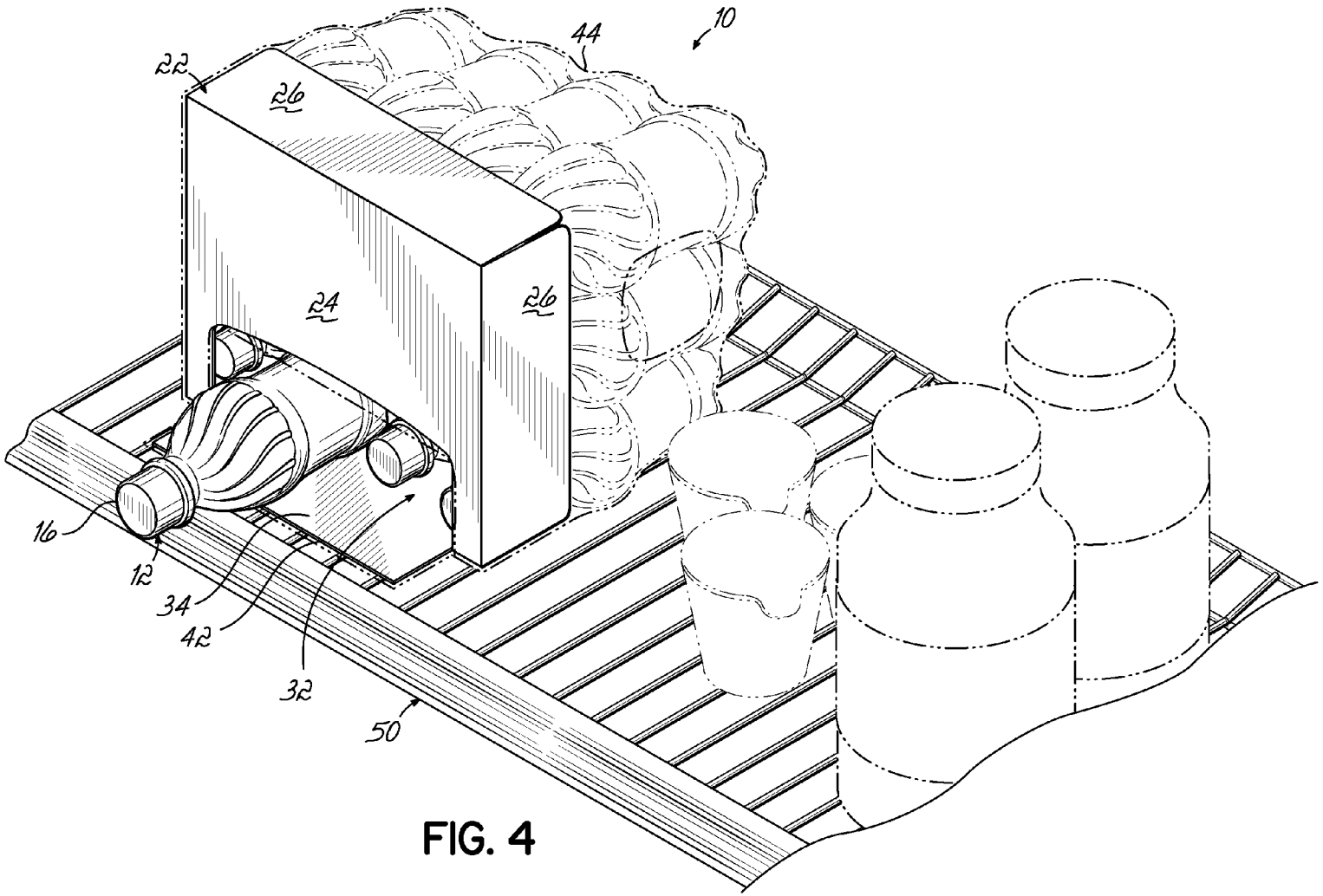
FIG. 4 is a view similar to FIG. 3 showing one of the beverage containers of the package being removed through a dispenser of the package with the package supported on a shelf.

A user, such as a consumer or retail purchaser of the package 10, may place the package 10 on a shelf 50 of a refrigerator, storage cabinet or the like as is shown in FIG. 4. In one embodiment, the package 10 is reoriented so that the containers 12 and package 10 lay on one of its sides with the dispenser 32 positioned adjacent the shelf 50. Alternately, the containers 12 in the package 10 may be removed from the package 10 through the dispenser 32 even when the containers 12 are upright as in FIG. 3.

Nevertheless, the package 10 may be shipped, stored or otherwise processed with the containers 12 in the upright configuration of FIG. 3 and then rotated to the orientation of FIG. 4 for consumer use and dispensing of the beverage containers 12. A user merely inserts his or her fingers through the weakened portion 46 of the overwrap member 44 and into the dispenser 32 thereby tearing the overwrap member 44 while grasping the dispenser flap 34 and pulling it downwardly. The dispenser flap 34 tears along the tear lines 38 so that it may be positioned in a generally horizontal orientation, perpendicular to the central panel 24 and generally parallel with the associated perimeter panel 26*a*. As such, the dispenser 32 provides access through which a user may grasp and retrieve one of the beverage containers 12 of the package 10. The dispenser 32 according to one embodiment of this invention as shown in FIG. 4 provides access to more than one of the beverage containers 12 and, as each beverage container 12 is removed from the package 10 through the dispenser 32, the remaining beverage containers 12 will reposition themselves via gravity to be adjacent the dispenser 32 for convenient access and removal from the package 10 by the user.

Additionally, a user may fold the dispenser flap 34 upwardly to a closed position generally parallel with the central panel 24 and reorient the package 10 after some of the beverage containers 12 have been removed from the package for convenient transport or further storage of the remaining containers 12 as needed. As such, the partially filled package 10 may then be laid on its side on a shelf 50 for access to the remaining beverage containers 12 as desired. Once all of the beverage containers 12 are removed from the package 10, the overlay member 22 and overwrap member 44 may be discarded or recycled as desired.

The package 10 according to one embodiment of this invention may include finger holes in the overlay member 22 and/or overwrap member 44 for insertion of a user's fingers for carrying and transport of the package 10 prior to or after the dispenser 32 has been accessed.

From the above disclosure of the general principles of the present invention and the preceding detailed description of at least one preferred embodiment, those skilled in the art will readily comprehend the various modifications to which this invention is susceptible. Therefore, I desire to be limited only by the scope of the following claims and equivalents thereof.

I claim:

1. A package supported on a horizontal shelf for dispensing contents of the package, the package comprising:

a plurality of beverage containers arranged in an array and each having a longitudinal end and a longitudinal axis, the beverage containers each being oriented horizontally with its longitudinal axis oriented horizontally;

an overlay member positioned proximate the longitudinal ends of the beverage containers;

a dispenser formed in the overlay member;

a dispenser flap adapted to be pulled outwardly from the overlay member while remaining attached to the overlay member to provide an opening through which at least one of the beverage containers may be removed from the package;

an overwrap member enveloping at least a substantial portion of the array of beverage containers and the overlay member; and a portion of the overwrap member being weakened relative to a remainder of the overwrap member via a line of perforations in the overwrap member and being positioned relative to the dispenser to allow a user to puncture the overwrap member in the vicinity of the weakened portion and gain access to at least one of the beverage containers via the dispenser and remove the beverage containers in a horizontal direction generally in the direction of the longitudinal axis of the beverage container through the dispenser.

2. The package of claim 1 wherein the overlay member further comprises:

a central, generally planar panel positioned on the longitudinal ends of the beverage containers wherein the dispenser is formed in the central panel.

3. The package of claim 2 further comprising:

a plurality of four perimeter panels each joined to and positioned on a perimeter of the central panel, each perimeter panel being oriented generally perpendicularly relative to the central panel.

4. The package of claim 1 wherein the dispenser flap is generally coplanar with an adjacent perimeter panel joined to the perimeter of the central panel after it is pulled outwardly for removal of the at least one of the beverage containers.

5. The package of claim 1 further comprising:

a perforate line in the overlay member adapted to be torn when the dispenser flap is pulled outwardly from the overlay member;

wherein the perforate line in the overlay member is incongruent with the line of perforations in the overwrap member.

6. The package of claim 1 wherein the dispenser further comprises:

a dispenser opening in the overlay member through which at least one of the beverage containers may be removed from the package.

7. The package of claim 6 further comprising:

a dispenser flap adjacent the dispenser opening and adapted to be pulled outwardly from the overlay member while remaining attached to the overlay member to provide an increased opening in combination with the dispenser opening through which at least one of the beverage containers may be removed from the package.

8. The package of claim 1 wherein the dispenser is positioned adjacent a perimeter edge of the overlay member.

9. The package of claim 1 wherein the array of beverage containers includes a longitudinal and a lateral direction in which more beverage containers are arranged in the longitudinal direction than in the lateral direction and the dispenser is juxtaposed to the shelf and an edge of the dispenser aligned in the longitudinal direction.

10. The package of claim 1 wherein the longitudinal end of each beverage container is a top end.

11. The package of claim 1 wherein the overlay member and the overwrap member are configured to allow the beverage containers remaining in the package after at least some of the beverage containers are removed to re-position via gravity within the package to be proximate the dispenser.

12. A package comprising:

a plurality of beverage containers arranged in an array and each having a longitudinal end;

an overlay member positioned proximate the longitudinal ends of the beverage containers;

a dispenser opening formed within the overlay member;

an overwrap member enveloping at least a substantial portion of the array of beverage containers and the overlay member;

wherein the dispenser opening is positioned adjacent a perimeter edge of the overlay member; and a portion of the overwrap member being weakened relative to a remainder of the overwrap member via a line of perforations in the overwrap member and being positioned relative to the dispenser opening to allow a user to puncture the overwrap member in the vicinity of the weakened portion and gain access to at least one of the beverage containers via the dispenser opening;

wherein the package is supported on a shelf with a side of the package facing downwardly and the dispenser opening positioned proximate the downwardly facing side of the package and the shelf.

13. The package of claim 12 wherein the overlay member and the overwrap member are configured to allow the beverage containers remaining in the package after at least some of the beverage containers are removed to re-position via gravity within the package to be proximate the dispenser.

14. The package of claim 12 wherein the array of beverage containers includes a longitudinal and a lateral direction in which more beverage containers are arranged in the longitudinal direction than in the lateral direction and the dispenser is juxtaposed to the shelf and an edge of the dispenser aligned in the longitudinal direction.

15. A package supported on a horizontal shelf for dispensing contents of the package, the package comprising:

a plurality of similarly oriented beverage containers arranged in a single layer array and each having a top longitudinal end and a longitudinal axis, the beverage containers each being oriented horizontally with its longitudinal axis oriented horizontally;

an overlay member covering the longitudinal ends of the beverage containers, the overlay member having a central, generally planar rectangular panel positioned covering the longitudinal ends of the beverage containers and a plurality of perimeter panels each joined to and positioned on a perimeter of the central panel, each perimeter panel being oriented generally perpendicularly relative to the central panel;

a dispenser opening within the central panel of the overlay member through which at least one of the beverage containers may be removed from the package;

an overwrap member enveloping at least a substantial portion of the array of beverage containers and the overlay member, the overwrap member being film material shrink wrapped onto the plurality of containers and the overlay member; and a line of perforations in the overwrap member aligned with the dispenser opening to allow a user to puncture the overwrap member in the vicinity of the line of perforations and gain access to at least one of the beverage containers via the dispenser opening and remove the beverage containers in a horizontal direction generally in the direction of the longitudinal axis of the beverage container through the dispenser opening.

16. The package of claim 15 wherein the dispenser opening further comprises:

a dispenser flap adapted to be pulled outwardly from the overlay member while remaining attached to the overlay member to provide an opening through which at least one of the beverage containers may be removed from the package.

17. The package of claim 16 wherein the dispenser flap is generally coplanar with an adjacent one of the perimeter panels after it is pulled outwardly for removal of the at least one of the beverage containers.

18. The package of claim 16 further comprising:

a perforate line in the overlay member adapted to be torn when the dispenser flap is pulled outwardly from the overlay member, wherein the perforate line is incongruent with the line of perforations in the overwrap member.

19. The package of claim 15 further comprising:

wherein the line of perforations in the overwrap member is incongruent with the dispenser opening.

20. The package of claim 15 wherein the array of beverage containers includes a longitudinal and a lateral direction in which more beverage containers are arranged in the longitudinal direction than in the lateral direction and the dispenser opening is positioned adjacent the shelf and the overlay member aligned in the longitudinal direction.

21. The package of claim 15 wherein the overlay member and the overwrap member are configured to allow the beverage containers remaining in the package after at least some of the beverage containers are removed to re-position via gravity within the package to be proximate the dispenser.

22. A package supported on a horizontal shelf for dispensing contents of the package, the package comprising:

a plurality of similarly oriented beverage containers arranged in a single layer array having a longitudinal and a lateral direction and each beverage container has a longitudinal end wherein more beverage containers are arranged in the longitudinal direction than the lateral direction, the beverage containers each being oriented horizontally with its longitudinal axis oriented horizontally;

a paperboard overlay member covering the longitudinal ends of the beverage containers, the overlay member having a central, generally planar rectangular panel positioned on the longitudinal ends of the beverage containers and a plurality of perimeter panels each joined to and positioned on a perimeter of the central panel, each perimeter panel being oriented generally perpendicularly relative to the central panel;

a dispenser opening in the central panel of the overlay member and juxtaposed to a longitudinal perimeter edge of the overlay member and the shelf;

a dispenser flap adjacent the dispenser opening and a perimeter edge of the overlay member, the dispenser flap being adapted to be pulled outwardly from the overlay member while remaining attached to the overlay member to a horizontal orientation and to provide access in combination with the dispenser opening through which at least one of the beverage containers may be removed from the package in a horizontal direction generally in the direction of the longitudinal axis of the beverage containers, the dispenser flap being generally coplanar with an adjacent one of the perimeter panels after it is pulled outwardly for removal of the at least one of the beverage containers;

a perforate line in the overlay member adapted to be torn when the dispenser flap is pulled outwardly from the overlay member;

an overwrap member enveloping at least a substantial portion of the array of beverage containers and the overlay member, the overwrap member being film material shrink wrapped onto the plurality of containers and the overlay member; and a line of perforations in the overwrap member being incongruent with the dispenser opening to allow a user to puncture the overwrap member in the vicinity of the line of perforations and gain access to at least one of the beverage containers via the dispenser;

wherein the package is adapted to be supported on the shelf with a side of the package facing downwardly and the dispenser positioned proximate the downwardly facing side of the package and the shelf.

23. The package of claim 22 wherein the overlay member and the overwrap member are configured to allow the beverage containers remaining in the package after at least some of the beverage containers are removed to re-position via gravity within the package to be proximate the dispenser.

24. The package of claim 22 wherein the array of beverage containers includes a longitudinal and a lateral direction in which more beverage containers are arranged in the longitudinal direction than in the lateral direction and the dispenser is juxtaposed to the shelf and an edge of the dispenser aligned in the longitudinal direction.

* * * * *

UNITED STATES PATENT AND TRADEMARK OFFICE

CERTIFICATE OF CORRECTION

PATENT NO. : 7,942,263 B2
APPLICATION NO. : 12/252601
DATED : May 17, 2011
INVENTOR(S) : Steven J. Block It is certified that error appears in the above-identified patent and that said Letters Patent is hereby corrected as shown below:

Title Page, Item (57) in the Abstract

Approximately line 22, "through the beverage containers", should read -- through which the beverage containers --.

In the Claims

In Col. 7, lines 13-14, "having a top longitudinal end", should read -- having a longitudinal end --.

Signed and Sealed this
Second Day of August, 2011

David J. Kappos

David J. Kappos
*Director of the United States Patent and Trademark Office*